United States Patent [19]

Brunet

[11] 4,359,924

[45] Nov. 23, 1982

[54] STRINGED INSTRUMENT NECK CONSTRUCTION

[76] Inventor: James W. Brunet, 215 Vann St., Syracuse, N.Y. 13206

[21] Appl. No.: 306,264

[22] Filed: Sep. 28, 1981

[51] Int. Cl.[3] ..... G10D 3/00

[52] U.S. Cl. ..... 84/293; 84/314 N

[58] Field of Search ..... 84/267, 291–293, 84/314 R, 314 N

[56] References Cited

U.S. PATENT DOCUMENTS

| | | | |
|---|---|---|---|
| 549,966 | 11/1895 | Hutchins | 84/292 |
| 977,127 | 11/1910 | Rengert et al. | 84/293 |
| 2,795,988 | 6/1957 | Maccaferri | 84/293 |
| 3,072,007 | 1/1963 | Burke | 84/267 |
| 4,145,948 | 3/1979 | Turner | 84/293 |

FOREIGN PATENT DOCUMENTS

| | | | |
|---|---|---|---|
| 285950 | 2/1928 | United Kingdom | 84/314 R |

*Primary Examiner*—Lawrence R. Franklin

*Attorney, Agent, or Firm*—Charles S. McGuire

[57] ABSTRACT

A neck construction for attachment to the body of a guitar, or similar stringed instrument, which includes a headpiece, elongated neck and means for attachment to the instrument body, all formed as a unitary metal casting, only the fretted fingerboard being an initially separate piece. The elongated portion has a unique configuration, including a lower curved portion with an integral upper wall consisting of flat, planar portions extending inwardly from the edges of the curved portion to spaced, opposing edges. The fingerboard is affixed to the planar portions in covering relating thereto and thus to the space therebetween, to define an enclosed chamber along the majority of the neck's length, which is of uniform shape and thickness, tapering gradually outwardly from the head toward the end attached to the body. The attachment may be integral, i.e., by forming the neck and body as a single piece, or by other securing means when the neck and body are initially separate.

9 Claims, 5 Drawing Figures

STRINGED INSTRUMENT NECK CONSTRUCTION

BACKGROUND OF THE INVENTION

The present invention relates to neck constructions for stringed instruments and, more specifically, to a unique neck structure formed as a unitary metal casting with a fingerboard affixed thereto.

Stringed instruments have been provided with the body and neck unitarily formed, i.e., from a single piece of material, but it is more common to fabricate the body and neck as separate elements which are joined to form the finished instrument. One of the problems with necks, especially those made of wood or plastic, is their tendency to warp. To this end, various reinforcing or stiffening means have been provided such as, for example, those shown in U.S. Pat. Nos. 2,497,116 and 4,200,023, which include parts of both wood and metal.

Guitar necks entirely or primarily of metal have also been provided, such as that of U.S. Pat. No. 4,189,974, which comprises an open, U-shaped channel member with frets supported by and bridging the edges thereof. An objectionable feature of metal guitar necks has been that, in order to provide the necessary rigidity, it has been necessary to make the neck of such thickness that it takes a substantial period of time to warm up after being exposed to cold temperatures due to the relatively high conductivity.

It is a principal object of the present invention to provide a metal neck construction for guitars, or similar stringed instruments, of unique design providing both exceptional rigidity and thin cross section.

Another object is to provide a neck construction for attachment to a guitar body which is formed as a single, unitary metal casting with a standard fingerboard affixed thereto to provide a hollow, enclosed chamber along the majority of its length.

Other objects will in part be obvious and will in part appear hereinafter.

SUMMARY OF THE INVENTION

In accordance with the foregoing objects, the invention contemplates a neck construction formed by providing a suitable mold into which molten metal, preferably aluminum, is cast to result in an integral, unitary piece having a head for supporting the usual string pens at one end, suitable means for attachment to a guitar body at the other end, and an elongated section of unique design joining the two ends. The elongated section, i.e., the neck per se, is of uniform shape and thickness along substantially its entire length. The cross section at any point along its length includes a curved lower portion having edges from which flat, planar upper wall portions extend inwardly to spaced, opposing edges. The flat, lower surface of the fingerboard is fixedly attached to the two flat upper wall partions, thus covering the space between the opposing edges thereof and forming an enclosed chamber of approximately semi-circular cross section.

The rigidity provided by the above-described neck cross sectional configuration permits very small wall thicknesses to be used. For example, no loss of rigidity has been encountered in guitar necks of this configuration having a uniform wall thickness of 1/16th of an inch. This results not only in savings of materials and reduced weight, but also in the very important advantage of allowing the neck to reach room temperature in a shorter time, after being exposed to cold temperatures during trasportation, etc., than metal necks of thicker cross section. Although remaining of the same cross sectional shape and thickness along its length, the elongated neck portion tapers outwardly from the head to the end attached to the instrument body, as do the opposed edges of the upper wall portion. The space between the upper wall edges is preferably about one-quarter of the total width of the upper wall.

DETAILED DESCRIPTION

Figure 1:
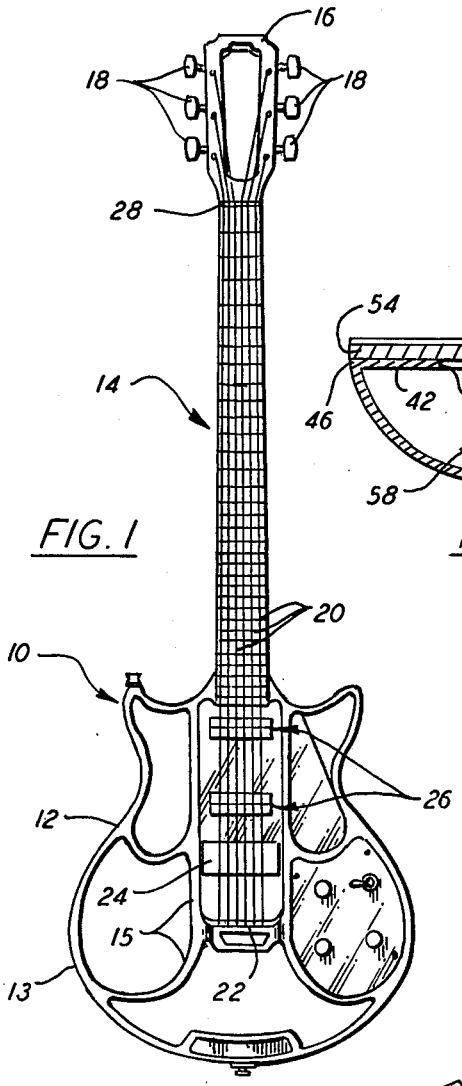
FIG. 1 is a front elevational view of a guitar wherein the neck construction of the invention is formed integrally with the guitar body.
Figure 2:
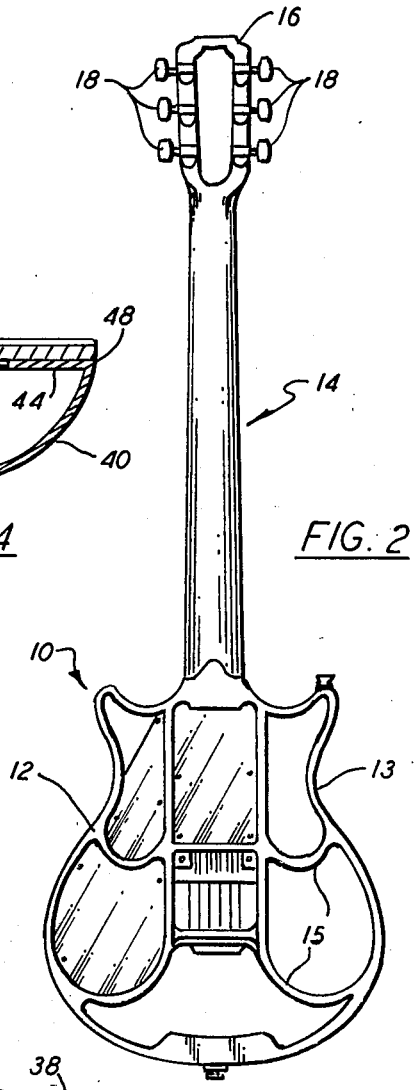
FIG. 2 is a rear elevational view of the guitar of FIG. 1.

Referring now to the drawing, in FIGS. 1 and 2 is shown a stringed instrument in the form of a guitar, denoted generally by reference numeral 10, including body portion 12, neck construction 14 having integral headpiece 16 supporting the usual tuning pegs 18. Strings 20 are attached at one end in the usual manner to pegs 18 and at the other end to tail piece 22, passing over bridge 24 and conventional magnetic pickups 26 for sound amplification. Body portion 12 may be formed as a unitary metal casting having a peripheral shape defined by continuous rib 13 with a plurality of internal ribs 15 extending through the space enclosed by rib 13. As is apparent from the drawing, some of the spaces enclosed by ribs 13 and 15 are open, while elements such as the magnetic pick-ups and electronic devices are supported in other such spaces.

Figure 4:
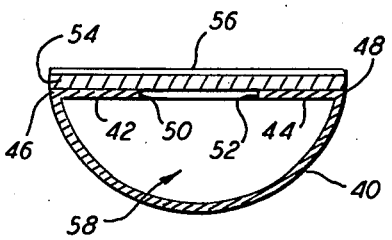
FIG. 4 is a cross sectional end view of the neck taken on the line 4—4 of FIG. 3.
Figure 3:
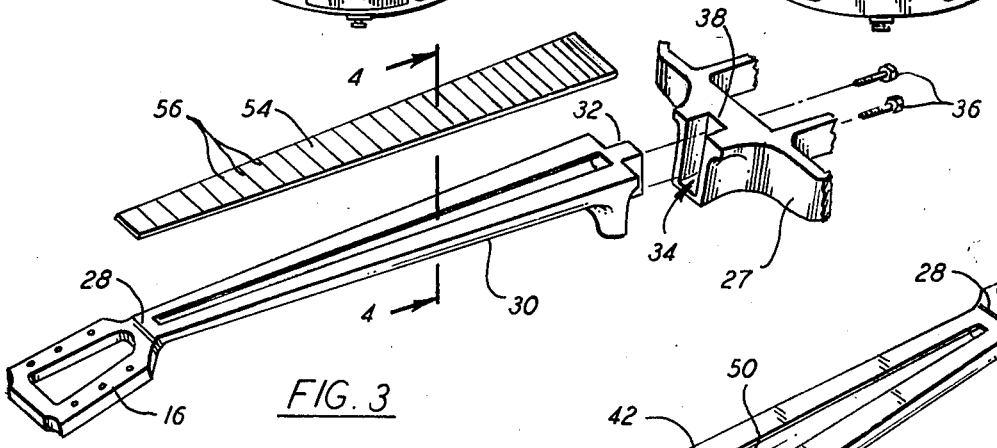
FIG. 3 is an exploded perspective view of the neck construction, showing also a fragment of an initially separate guitar body with means for connecting the neck and body.
Figure 5:
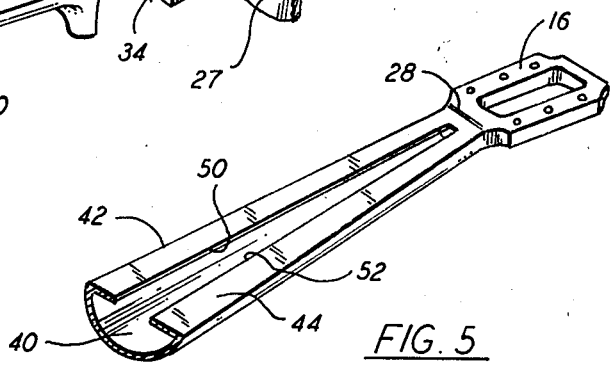
FIG. 5 is a perspective view, in section, of the upper portion of the neck construction.

The structural features of neck construction 14 are most clearly seen with reference to FIGS. 3-5. The structural features of the neck construction are the same whether the neck is attached to the body by virtue of being integral therewith, as in the case of the unitary metal casting encompassing both neck and body portions, or the neck and body are formed as initially separate portions which are connected at a joint. Thus, the term "means connecting the neck and body portions," or words of similar import as used in the present application, is intended to encompass integral connection of the neck and body, as well as joining two initially separate parts. Common reference numerals are therefore used for all elements of neck construction 14 throughout the drawing Figures, while different numerals are used for the integral body 12 and the initially separate body portion, the fragment of which is shown in FIG. 3 being denoted by reference numeral 27. Transverse member 28, usually termed the nut, is formed integrally with the neck construction at the juncture of headpiece 16 and elongated portion 30 and has grooves for retaining the strings in the desired lateral relationship. Formed integrally with elongated portion 30 at the end opposite headpiece 16 are means for connecting the neck construction to the body. Although the specific form of the connecting means does not concern or limit the present invention, the means illustrated include projecting portion 32 on the end of the neck construction which mates with a like groove 34 in body portion 27. Body and neck portions 27 and 14 are securely joined by screws 36 which pass through openings in partition 38 of the body into tapped holes in projecting portion 32 on neck 14. Obviously other, equally effective connecting means may be employed.

*Elongated portion* 30 *includes curved wall portion* 40, termed the lower wall since it is on the rear or lower part of the guitar as the latter is normally viewed or played. The inner and outer surfaces of wall 40 are preferably concentric, circular chords of somewhat less than 180°. That is, wall 40 is somewhat less than a full semi-circular, although it may be described as defining a generally semi-circular channel. The upper wall portion is formed by flat, planar walls 42 and 44 extending inwardly and integrally from edges 46 and 48, respectively, of curved wall 40. Walls 42 and 44 terminate in spaced, opposing edges 50 and 52, respectively. Fingerboard 54 having spaced frets 56, which may be purchased as a standard commercial item, has a flat, planar lower surface and is fixedly attached by any conventional means to the upper surfaces of walls 42 and 44, as indicated in FIG. 4, thereby forming enclosed, generally semi-circular chamber 58.

Although elongated portion 30 is of the same shape in cross section in any plane normal to its long axis along substantially its entire length, it becomes larger, tapering uniformly outwardly, from the end at which it is connected to the headpiece to the end connected to the instrument body. Likewise, edges 50 and 52 diverge in the same direction as the taper, although they may, if desired, be formed to remain parallel. Elongated portion 30 is of uniform thickness along substantially its entire length, as well as throughout its cross section. That is, all of walls 40, 42 and 44 are of equal thickness. The superior rigidity provided by the configuration of the walls permits the use of relatively thin wall sections, preferably on the order of 1/16th of an inch, without significant tendency to bend, warp, etc. Upper wall portions 42 and 44 preferably extend a total of between about two-thirds and three-quarters of the total distance between edges 46 and 48 of lower wall portion 40. In other words, the liner distance between edges 50 and 52 is about one-third to one-quarter the width of the upper wall of neck 14.

What is claimed is:

1. A neck construction for attachment to the body of a stringed intrument comprising:

(a) a headpiece at one end adapted to support a plurality of string pegs;

(b) means for attaching said neck construction to the stringed instrument body at the end opposite said head piece;

(c) an elongated portion extending between said ends and having a cross section in a plane normal to its axis of substantially uniform thickness and shape throughout its length;

(d) said uniform shape including a curved lower wall portion and a pair of flat, planar upper wall portions extending inwardly for equal distances from each edge of said lower wall portion, said equal distances each being less than one-half the distance between said lower portion edges, whereby a linear space is provided between two opposing edges of said upper wall portions;

(e) all of said headpiece, attaching means and elongated portion being formed as a single, integral and unitary metal casting; and (f) a fingerboard having a lower, planar surface affixed in covering relation to substantially all of said upper wall portions, and an upper surface carrying a plurality of frets.

2. The invention according to claim 1 wherein said elongated portion tapers uniformly outwardly from said headpiece to said attaching means.

3. The invention according to claims 1 or 2 wherein said curved lower wall portion comprises a chord of a circle extending for less than 180° about the axis of the circle.

4. The invention according to claims 1 or 2 wherein said uniform thickness is less than ⅛th inch.

5. The invention according to claims 1 or 2 wherein said uniform thickness is approximately 1/16th inch.

6. The invention according to claims 1 or 2 wherein said equal distances total between two-thirds and three-quarters of the distance between said lower wall portion edges.

7. The invention according to claim 1 wherein said attaching means comprises a joint between initially separate neck and body portions of said instrument and fastening means maintaining said neck and body portions in firm engagement at said joint.

8. The invention according to claim 1 wherein said attaching means comprises an integral connection of said neck and body portions, all of which are formed as a unitary, integral metal casting.

9. The invention according to claim 8 wherein said body portion has an outline defined by a continuous metal rib and includes a plurality of internal ribs formed integrally with and extending through the space enclosed by said continuous rib.

* * * * *